US011215434B2

(12) United States Patent
Torrance et al.

(10) Patent No.: US 11,215,434 B2
(45) Date of Patent: Jan. 4, 2022

(54) METHOD AND SYSTEM FOR WIRELESS MEASUREMENT OF DETONATION OF EXPLOSIVES

(71) Applicant: QMR (IP) PTY LTD, Brisbane (AU)

(72) Inventors: Alastair Courtenay Torrance, Cooks Hill (AU); Gary Lindsay Cavanough, Brisbane (AU)

(73) Assignee: QMR (IP) PTY LTD, Queensland (AU)

( * ) Notice: Subject to any disclaimer, the term of this patent is extended or adjusted under 35 U.S.C. 154(b) by 0 days.

(21) Appl. No.: 16/754,297

(22) PCT Filed: Oct. 9, 2018

(86) PCT No.: PCT/AU2018/051091
§ 371 (c)(1),
(2) Date: Apr. 7, 2020

(87) PCT Pub. No.: WO2019/071304
PCT Pub. Date: Apr. 18, 2019

(65) Prior Publication Data

US 2020/0309497 A1 Oct. 1, 2020

(30) Foreign Application Priority Data

Oct. 10, 2017 (AU) ..... 2017904086

(51) Int. Cl.
*F42D 1/055* (2006.01)
*F42D 3/04* (2006.01)
*F42D 5/02* (2006.01)

(52) U.S. Cl.
CPC ..... *F42D 1/055* (2013.01); *F42D 3/04* (2013.01); *F42D 5/02* (2013.01)

(58) Field of Classification Search
CPC ..... F42D 1/055; F42D 3/04; F42D 5/02
(Continued)

(56) References Cited

U.S. PATENT DOCUMENTS 2,724,453 A * 11/1955 Lee ..... G01V 1/003 367/40
2014/0311370 A1* 10/2014 Koekemoer ..... F42C 11/001 102/217

FOREIGN PATENT DOCUMENTS

| | | | |
|---|---|---|---|
| JP | 2002-071446 | A | 3/2002 |
| JP | 2014-222119 | A | 11/2014 |
| WO | 2014/055024 | A1 | 4/2014 |

OTHER PUBLICATIONS

Machine translation of JP 2002-071446 A, provided by STIC. (Year: 2021).*

(Continued)

*Primary Examiner* — Bret Hayes
(74) *Attorney, Agent, or Firm* — Meunier Carlin & Curfman LLC

(57) ABSTRACT

A system (10) for wireless measurement of detonation of explosives (3) for detonation according to a timed sequence, the system comprising: an antenna (15, 16) for detecting electromagnetic emissions caused by detonation of the explosives and providing an electromagnetic signal representative of the electromagnetic emissions; a data logger (12) operatively connected to the antenna for logging the electromagnetic signal; a trigger for setting the data logger for logging the electromagnetic signal upon detonation of the explosives to produce a recorded blast record; and a comparison arrangement for comparing the timed sequence with the recorded blast record.

14 Claims, 7 Drawing Sheets

(58) Field of Classification Search
USPC ..... 102/206, 217
See application file for complete search history.

(56) References Cited

OTHER PUBLICATIONS

Machine translation of JP 2014-222119 A, provided by STIC. (Year: 2021).*
International Search Report and Written Opinion issued in corresponding application No. PCT/AU2018/051091, dated Dec. 20, 2018, 12 pages.

* cited by examiner

METHOD AND SYSTEM FOR WIRELESS MEASUREMENT OF DETONATION OF EXPLOSIVES

FIELD

The present disclosure relates to a method and system for wireless measurements of detonation of explosives especially, but not exclusively, in mining operations. The disclosure has application to the wireless measurement of the detonation of blast holes having one or more explosive charges therein, without or without stemming. However, the disclosure is not necessarily limited thereto.

DEFINITION

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

BACKGROUND

In blasting operations, the timing of detonation is critical to the blast outcomes and hence is predetermined and documented. However, it has not been possible to monitor a blast to confirm the timing is correct and if in fact detonation of all the explosives has occurred. In the case of detonation not occurring, the explosive products are normally discovered during excavation. These discoveries are termed misfires and present significant safety risk and financial impact.

Measurement of the detonation of explosives in blasting operations according to the prior art uses accelerometers bound about the surrounding rock mass and linked by wires to a recording instrument. The accelerometers measure shockwaves from the blast of each explosion as vibrations. The recorded vibrations can infer detonation to some extent. However, the complexity of the recorded measurements has confined its use mainly to experimental work for underground mining.

The velocity of detonation (VOD) is the accepted method to ascertain the detonation performance of bulk explosive. Current technology limits the quantity of these measurements due to the need of having sensor cables placed in the explosive and hardwired to the monitoring equipment. Hence it is not practical to measure more than a few holes and to measure holes that are surrounded by other holes as the adjacent detonations destroy the cabling to the monitoring equipment prior to the completion of the measurement.

The present disclosure provides a method and system for wireless measurement of detonation of explosives, which at least in certain embodiments avoids or alleviates one or more of the shortcomings of previously known methods of measuring the detonation of explosives in blasting operations, or at least provides a useful alternative.

The reference to prior art or other background in this specification is not, and should not be taken as, an acknowledgment or any form of suggestion that the referenced prior art or other background forms part of the common general knowledge in Australia or in any other country.

SUMMARY

According to a first aspect of the present disclosure there is provided a system for wireless measurement of detonation of explosives for detonation according to a timed sequence, the system comprising:

an antenna for detecting electromagnetic emissions caused by detonation of the explosives and providing an electromagnetic signal representative of the electromagnetic emissions;

a data logger operatively connected to the antenna for logging the electromagnetic signal;

a trigger for setting the data logger for logging the electromagnetic signal upon detonation of the explosives to produce a recorded blast record; and a comparison arrangement for comparing the timed sequence with the recorded blast record.

In an embodiment, the system is for wireless measurement of detonation of explosives contained in a plurality of spaced blast holes.

In an embodiment, the system is for wireless measurement of detonation of a plurality of explosive charges contained in respective spaced blast holes.

In an embodiment, the system is for wireless measurement of detonation of explosives contained in a plurality of spaced blast holes in a mine.

In an embodiment, the electromagnetic emissions are electromagnet pulses caused by detonation of chemical explosives.

In an embodiment, the explosives are chemical explosives.

In an embodiment, the antenna comprises a ground antenna.

In an embodiment, the antenna comprises an aerial antenna.

In an embodiment, the antenna comprises a wire cable system connected to and used to configure electronic detonators which initiate the detonation of the explosives.

In an embodiment, the antenna comprises at least one metal electrode connected to a ground mass.

In an embodiment, the ground mass comprises a rock mass.

In an embodiment, the ground mass is a rock mass.

In an embodiment, the antenna comprises at least one metal electrode connected to a ground mass by insertion into a hole provided in the ground mass.

In an embodiment, the antenna comprises at least one metal electrode connected to a ground mass by insertion at least 150 mm into a hole provided in the ground mass.

In an embodiment, the antenna comprises at least one metal electrode connected to a ground mass by insertion into a predrilled hole in the ground mass.

In an embodiment, the antenna comprises at least two metal electrodes connected to a ground mass.

In an embodiment, the antenna comprises at least two metal electrodes connected to a ground mass by insertion into respective predrilled holes in the ground mass.

In an embodiment, at least one metal electrode comprises a steel rod.

In an embodiment, the antenna comprises an elongate conductor provided above a floor or ground surface.

In an embodiment, the elongate conductor comprises an aerial.

In an embodiment, the antenna comprises at least one elongate conductor provided above a floor or ground surface and at least one metal electrode connected to a ground mass by insertion into a predrilled hole in the ground mass.

In an embodiment, the antenna comprises a single aerial conductor and a single metal electrode connected to a ground mass by insertion at least 150 mm into a hole provided in the ground mass In an embodiment, the antenna comprises a wire cable system connected to and used to configure electronic detonators.

In an embodiment, the antenna is connected to the data logger by coaxial cable.

In an embodiment, the data logger is a high speed data logger.

In an embodiment, the high speed logger records at a sampling frequency of at least 100 kHz.

In an embodiment, the high speed logger records at a sampling frequency of at least 200 kHz.

In an embodiment, the high speed logger records at a frequency sufficiently high to provide capability to integrate short duration high speed impulses in a preconditioning electronic circuit prior to acquisition at least 100 kHz. In an embodiment the frequency is greater than 1 MHz.

In an embodiment, the system comprises a signal amplifier for amplifying the signal provided by the antenna.

In an embodiment, the signal amplifier is provided by the data logger.

In an embodiment, the signal amplifier is operable by control of a signal gain function of the data logger.

In an embodiment, the system comprises a testing arrangement for testing operation of the data logger prior to detonation of the explosives.

In an embodiment, the testing arrangement is provided by a testing function of the data logger.

In an embodiment, the trigger is provided as a trigger function of the data logger.

In an embodiment, the data logger is configured to be triggered when the signal from the antenna exceed a threshold.

In an embodiment, the data logger is configured to be triggered by sound or pressure waves in air.

The data logger may be operatively connected to a microphone.

The data logger may be operatively connected to a microphone such that detection by the microphone of sound, or pressure waves in air, having predefined characteristics operates the trigger.

In an embodiment, the data logger has a non-triggered mode in which it records data to short term memory, and overwrites new data over data previously recorded to said short term memory.

In an embodiment, the data logger has a triggered mode in which it records or logs data to long term memory.

In an embodiment, the system comprises a trigger reset arrangement for resetting the trigger.

In an embodiment, the trigger reset arrangement is adapted to reset the trigger to a pre-triggered state, so that the trigger is receptive to a triggering signal and responds to the triggering signal by initiating operation of the data logger to log said electromagnetic signal representative of the electromagnetic emissions produced by the detonation of the explosives.

In an embodiment, the trigger reset arrangement comprises a trigger reset arrangement of the data logger.

In an embodiment, the timed sequence is a predetermined intended timed sequence.

In an embodiment, the comparison arrangement is for identifying inconsistences between the timed sequence and the recorded blast record.

In an embodiment, the comparison arrangement comprises a computer which receives data from the data logger.

In an embodiment, the comparison arrangement comprises a computer which receives data comprising the recorded blast record from the data logger.

In an embodiment, the comparison arrangement comprises a computer which receives data comprising the timed sequence.

In an embodiment, the timed sequence comprises scheduled detonation timing.

In an embodiment, the comparison arrangement comprises a detonation matching functionality for matching the individual detonations represented by the recorded blast record to corresponding scheduled detonations of the timed sequence.

In an embodiment, the comparison arrangement is accommodated by a computer program operable to compare scheduled detonation timing information with data recorded by the data logger.

In an embodiment, the comparison arrangement is operable to identify, for each scheduled detonation, whether the signal representative of the electromagnetic emissions indicates that a corresponding detonation has been detected.

In an embodiment, the comparison arrangement is operable to identify, for each scheduled detonation in relation to which a corresponding detonation has not been detected, that a misfire has occurred.

In an embodiment, the comparison arrangement is operable to calculate a timing difference between each scheduled detonation and the timing of a corresponding detonation included in the recorded blast record.

In an embodiment, the comparison arrangement is operable to output the calculated timing difference between each scheduled detonation and the timing of a corresponding detonation included in the recorded blast record.

In an embodiment, the computer is operable to calculate the duration of each detonation included in the recorded blast record.

In an embodiment, the computer receives data relating to the charge length of each explosive.

In an embodiment, the computer is operable to calculate the velocity of detonation for each explosive.

In an embodiment, the computer is operable to calculate the velocity of detonation for each explosive based on the charge length of each explosive, and the duration of the detonation of that explosive.

According to a second aspect of the present disclosure, there is provided a method for wireless measurement of detonation of explosives for detonation according to a timed sequence, the method comprising:

providing an antenna for detecting electromagnetic emissions caused by detonation of the explosives so that the antenna provide an electromagnetic signal representative of the electromagnetic emissions;

providing a data logger operatively connected to the antenna for logging the electromagnetic signal;

using a trigger to set the data logger for logging the electromagnetic signal upon detonation of the explosives to produce a recorded blast record; and comparing the timed sequence with the recorded blast record.

In an embodiment, the antenna is provided between 10 and 90 metres of at least one of the explosives to be detonated.

In an embodiment, the antenna is provided between 30 and 60 metres of at least one of the explosives to be detonated.

In an embodiment, the data logger is provided in a protected position remote from the blast.

In an embodiment, the data logger is provided between 10 m and 90 m from the blast.

In an embodiment, the data logger is placed in a position separated from the blast by a rock mass.

It should be appreciated that features of embodiments described in relation to the system of the first aspect may be incorporated into the method of the second aspect mutatis mutandis.

According to a third aspect of the present disclosure, there is provided a method of measuring the velocity of transmission of a pressure wave through a ground mass, comprising:

detecting a pressure wave travelling through the ground mass, resulting from detonation of explosives, at a location a known distance from the detonation of the explosives;

detecting electromagnetic emissions caused by the detonation of the explosives; and using (i) the interval between the detection of the electromagnetic emissions and the detection of the pressure wave and (ii) the known distance, to calculate the velocity of propagation of the pressure wave through the ground mass.

In an embodiment the ground mass comprises a rock mass.

In an embodiment the explosives are located in a blast hole.

In an embodiment the explosives are located in a blast hole in a mine.

In an embodiment the detection of the pressure wave comprises use of a pressure sensor.

In an embodiment the pressure sensor is located in a hole.

In an embodiment the pressure sensor is located in a hole provided in the ground mass.

In an embodiment the pressure sensor is located in a blast hole.

In an embodiment the pressure sensor is located in a blast hole in a mine.

In an embodiment the detecting of electromagnetic emissions caused by the detonation of the explosives comprises use of a system as described above in relation to the first aspect.

In an embodiment the detecting of electromagnetic emissions caused by the detonation of the explosives comprises use of a method as described above in relation to the second aspect.

BRIEF DESCRIPTION OF THE DRAWINGS

Embodiments will be described below, in detail, with reference to accompanying drawings. The primary purpose of this detailed description is to instruct persons having an interest in the subject matter of the invention how to carry the invention into practical effect. However, it is to be clearly understood that the specific nature of this detailed description does not supersede the generality of features or characteristics set out in the preceding Summary section. In the accompanying diagrammatic drawings.

DETAILED DESCRIPTION OF EMBODIMENTS

With reference to the accompanying drawings, embodiments of a system for wireless measurement of detonation of explosives will be described.

Figure 1:
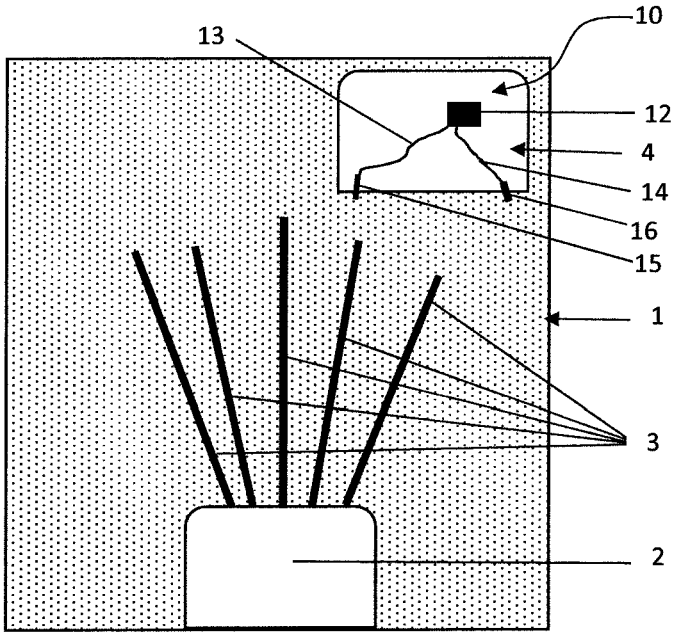
FIG. 1 illustrates schematically an example of an arrangement of explosives in an underground mine and apparatus for wireless measurement of detonation of the explosives, according to a first embodiment.

FIG. 1 illustrates schematically a rock mass 1 in an underground mine. The mine includes a first drive 2, in which blast holes 3 are drilled and loaded with explosives. The provision of blast holes in underground mines, loading of blast holes with explosive and detonation of the explosive according to a pre-scheduled, timed, sequence is known per se and will not be described in detail.

As illustrated in FIG. 1, a second drive 4, is provided. The second drive 4 is located above the first drive 2 and is not directly connected to the first drive 2. A system, generally designated 10, for wireless measurement of detonation of the explosives loaded in the blast holes 3 is provided in the second drive 4. The system 10 comprises a high speed data logger 12, which is electrically connected by first and second flexible cables 13, 14 to respective first and second steel rods 15, 16.

Figure 2:
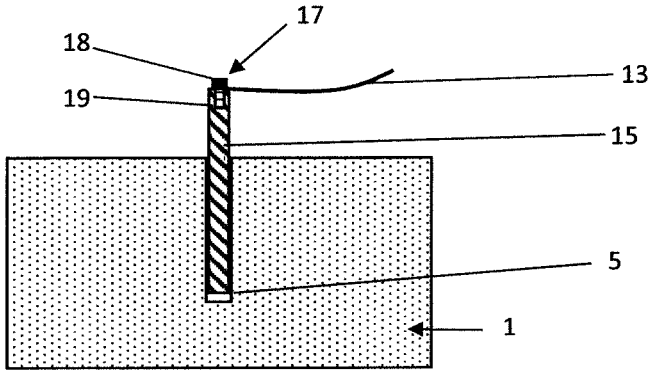
FIG. 2 illustrates schematically an example of a rod which may be used as an antenna in the arrangement of FIG. 1, in use.

The first steel rod 15, and its connection to the rock mass 1, are illustrated in more detail in FIG. 2.

As illustrated in FIG. 2, a hole 5 which extends into the rock mass 1 is provided. The hole 5 may be drilled into the floor of the second drive 4. The hole 5 is dimensioned to tightly accommodate the first steel rod 15. In an embodiment the first steel rod 15 is circular in transverse cross section and has a diameter of 5 mm, and hole 5 has an internal diameter of 5 mm to tightly accommodate the first steel rod 15. The first steel rod 15 may be driven into the hole 5 by hammering or any other suitable method.

The first flexible cable 13 is connected to the first steel rod 15 via a suitable electrical connection 17. In the illustrated embodiment the electrical connection 17 comprises a crimp eye connector (not shown) and a bolt 18 screwed into a threaded hole 19 provided at the end of the first steel rod 15.

In a variation the first steel rod 15 is provided with a tight 180 degree curve at its free (upper) end, and the electrical connection 17 is attached to a downwardly-pointing end of the first steel rod 15. This provides an uppermost surface part of the first steel rod 15 in the form of an external side of a tight curve, so that the uppermost surface part of the first steel rod 15 is free of any electrical connection and provides a surface which can be impacted, for example to hammer the first steel rod 15 into its hole 5.

The second steel rod 16 may correspond to the first steel rod 15 in terms of its shape and size, its accommodation in a respective hole (not shown) and attachment of the second flexible cable 14 thereto by use of a suitable electrical connection.

The flexible cables 13, 14 may be coaxial cables, and may be provided with suitable connections, such as screw connections, to facilitate connection to the high speed data logger 12.

The steel rods 15, 16 may be of any suitable length, and in the illustrated embodiment are approximately 300 mm in length, and inserted approximately 250 mm into the respective holes.

In a variation the steel rods may be approximately 6 mm in diameter and 200 mm long. The input impedance of the of such a sensor is approximately 10 Mohm and the sensor suitable for being located about 10 m to about 100 m from the explosive.

It will be appreciated that the first and second steel rods 15, 16 provide an antenna arrangement which connect the high speed data logger 12, to the rock mass 1. More specifically, in this embodiment, the first and second steel rods 15, 16 provide an antenna arrangement which connect one or more input amplifiers (see description below with reference to FIG. 6) of the high speed data logger 12 to the rock mass.

It has been found that detonation of chemical (conventional) explosives, such as those used in mining, results in an electromagnetic pulse (EMP) which has amplitude and duration related to the size and character of the explosive charge. The term chemical explosives is used herein to distinguish from atomic/nuclear explosives or explosions, for which the considerations relating to electromagnetic pulses are substantially different.

Without wishing to be bound by theory, it is believed that the EMP from chemical explosives is caused by a charge separation of explosive products after detonation. Electronic detonators are also known to create an EMP, although the duration is short due to the small mass of explosive.

In a column of explosive detonating in a blast hole, the detonation progresses through the explosive charge from an initiation location. The initiation is provided by a high energy detonation of a primer. Without wishing to be bound by theory, it is believed that the progression of the detonation in a single direction through the explosive charge results in rapidly generated and high energy ionized particles moving in one direction.

The EMP travels at the speed of light and has a duration substantially equal to the time span of detonation. It has been found that an EMP from detonation of a chemical explosive can be detected and recorded as data, which can be used to measure the detonation.

Further, it has been found that in timed sequences of detonations, such as those used in mining, the time interval between successive detonations is very often greater than the duration of each detonation, and that in this case the successive detonations result in a sequence of respective successive, substantially discrete, EMPs.

Detection of such a sequence of EMPs together with logging of signals representative of the EMPs by a high speed data logger can enable measurement of each successive detonation from which an EMP is detected.

With reference to the embodiment of FIGS. 1 and 2, the antenna arrangement comprising the first and second steel rods 15, 16 can detect the electromagnetic emissions (EMPs) induced by the sequential detonation of the explosives in the blast holes 3 and traveling through the rock mass 1. The antenna arrangement comprising the first and second steel rods 15, 16 provides an electromagnetic signal representative of those electromagnetic emissions. The high speed data logger 12 can log the electromagnetic signal. The logged electromagnetic signal will include information relating to the timing and durations of the detonations, which can then be used to measure the detonations. For example, the logged electromagnetic signal may be regarded as being a recorded blast record which can be compared to the pre-scheduled, intended, timing of the sequence of detonations. The comparison may be performed by a computer (not shown) which may be a portable battery operated (e.g. laptop) computer which may be located in the second drive 4 and may remain connected to the high speed data logger 12.

The steel rods 15, 16 may be a semipermanent installation used to monitor detonations anywhere in the rock mass 1 that produce sufficient magnitude of EMP at the location of the steel rods 15, 16.

Figure 3:
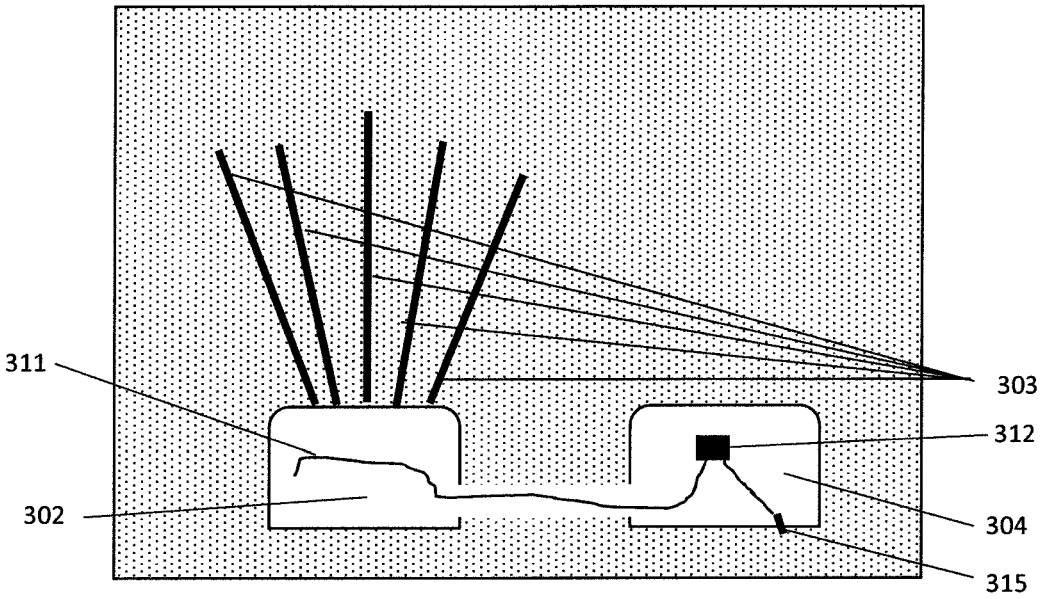
FIG. 3 illustrates schematically an example of an arrangement of explosives in an underground mine and apparatus for wireless measurement of detonation of the explosives, according to a second embodiment.

FIG. 3 shows an alternate configuration for an underground mine comprising a first drive 302, in which blast holes 303 are drilled and loaded with explosives. In the illustrated configuration a high speed data logger 312 is located in a drive 304 which is directly connected to the first drive 302.

In such an arrangement steps should be taken to ensure that the high speed data logger 312 is located in a position where it is not subjected to an air blast when the explosives in holes 303 are detonated. Air blasts, caused by movement of the rock mass, may readily destroy equipment.

In the configuration of FIG. 3 one input of the high speed data logger 312 is connected to an antenna 311 that is suspended in the air adjacent to the blast holes 303. The antenna 311 may be a length of suitable wire or conductive cable, such as, for example, a simple length of bell wire or coaxial cable. Placement of the antenna 311 can be carried out after the blast holes have been fully loaded and even after they have been tied in, subject to the usual safety precautions. The cable is not carrying a current and so is does not interfere with any form of detonation initiation system. In the case of a blast that is initiated using electronic detonators the wire cable system connected to and used to configure the electronic detonators can be used as the antenna.

A second input of the high speed data logger 312 is connected to the rock mass 301 by a ground antenna 315, which may correspond to the arrangement provided by the first steel rod 15 described above with reference to FIGS. 1 and 2. The high speed data logger 312 thus records the EMP, induced by detonation of the explosives in blast holes 303, traveling through the air.

Figure 4:
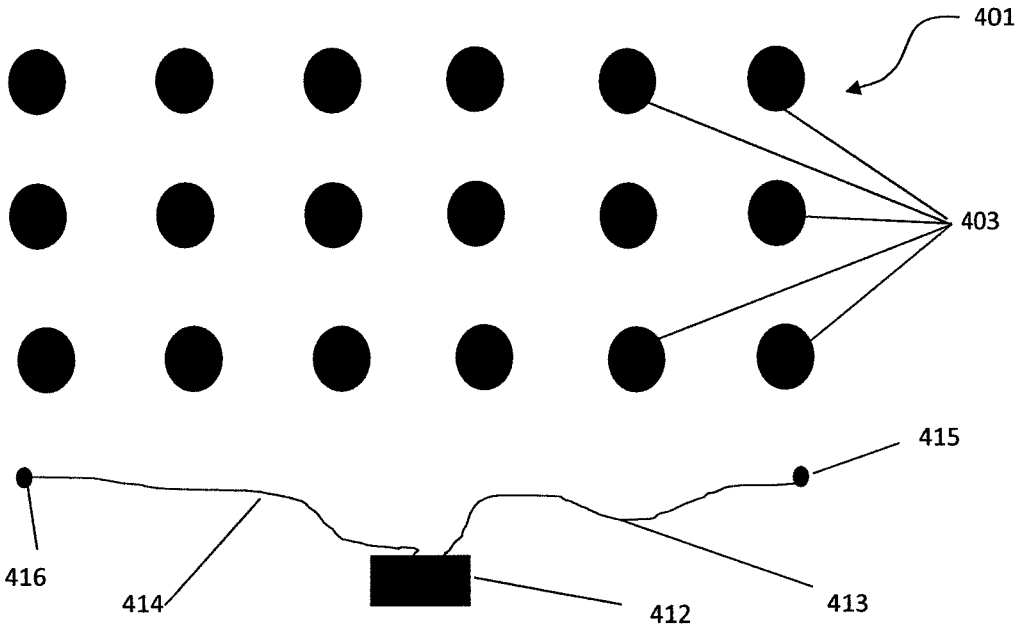
FIG. 4 illustrates schematically an example of an arrangement of explosives in an open cut mine and apparatus for wireless measurement of detonation of the explosives, according to a third embodiment.

FIG. 4 illustrates schematically a blast pattern in an open cut mine 401, consisting of blast holes 403 that are drilled and loaded with explosives. A high speed data logger 412 is located adjacent to the blast pattern. Flexible cables 413, 414 electrically connect the input amplifiers of the high speed data logger 412 to the rock mass via steel rods 415, 416. The steel rods 415, 416 and their connections to the rock mass and their respective flexible cables 412, 413, may be substantially the same as steel rods 15, 16 described above in relation to FIG. 2 and their respective connections.

In this configuration the high speed logger 412 records the EMP, induced by detonation of the explosives in holes 403, traveling through the rock mass.

Figure 5:
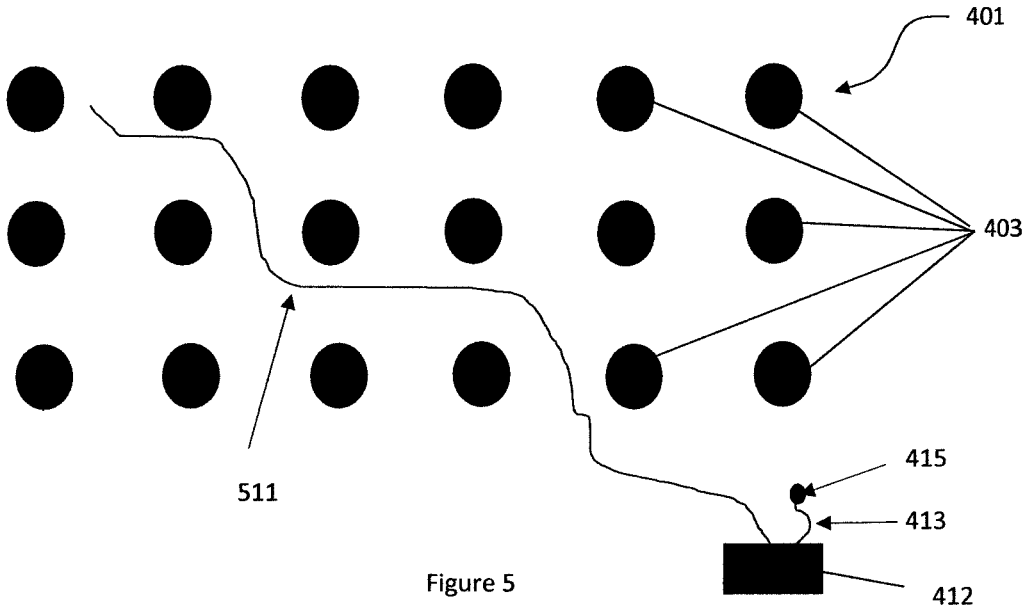
FIG. 5 illustrates schematically an example of an arrangement of explosives in an open cut mine and apparatus for wireless measurement of detonation of the explosives, according to a fourth embodiment.

FIG. 5 shows an alternate configuration for open cut mine 401. This configuration differs from the configuration of FIG. 4 mainly in that one input of the high speed logger 412 is connect to an antenna 511 that is suspended in the air adjacent to and across the blast pattern. The high speed logger 412 records the EMP, induced by detonation of holes 403, traveling through the air.

While various examples of antenna system configurations have been described by way of example, alternative configuration may be used without departing from the scope of the present disclosure.

Figure 6:
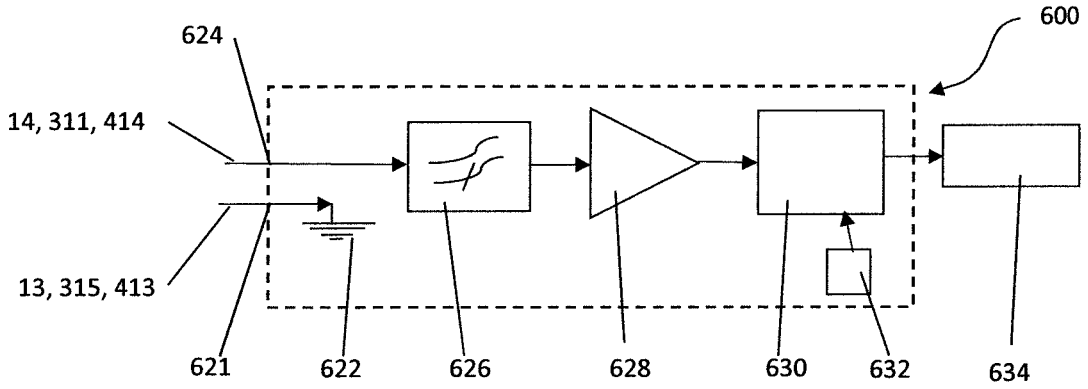
FIG. 6 illustrates schematically an example of a data logger which may be used in the embodiments if FIG. 1, 3, 4 or 5.

FIG. 6 is a schematic of a high speed logger, generally designated 600, of a type suitable for use as a high speed data logger (e.g. 112, 312, 412) in the embodiments described above in relation to FIGS. 1 to 5. A first input 621 of the high speed logger 600, corresponding to a signal ground 622 of the high speed logger 600, is connected to a first conductor or part of the antenna arrangement, for example, 13, 315, 413. A second input 624 of the high speed logger 600 is connected to a second conductor or part of the antenna arrangement, for example, 14, 311, 414. The second input 624 of the high speed logger 600 provides a connection to a high pass filter 626. The high pass filter 626 rejects low frequency voltages that may be induced in the antenna arrangement by charges from naturally occurring wind born ionized particles and ionized gases produced by detonation. The signal from the high pass filter 626 is then amplified by amplifier 628 and the signal is then recorded and/or logged by a data logging unit 630.

The data logger 600 may operate continuously, and temporarily record data in respect of the signal to short-term memory, and then overwrite newly acquired data over previously recorded data in a loop-like manner. A trigger arrangement 632 may be provided so that upon triggering of the data logger 600, by a predetermined or prearranged trigger signal, the data logger saves data acquired and or recently recorded but not yet overwritten, to long term memory for subsequent use, for example in a computer 634.

A trigger signal may be provided by detection of the signals from the antenna exceeding a threshold amplitude. This may correspond to a first detonation related EMP, for example, a first detonation of a sequence, which can also provide a time base by which to reference to all logged data.

In an alternative the triggering signal may be provided by detection of a noise detected by an inbuilt microphone, in which case a noise (overpressure) associated with one or more of the detonations to be measured may provide a suitable signal. In this case, it will be appreciated that because the speed of sound is substantially slower than the speed of light, the triggering noise will be detected at the data logger after the EMP from the detonations. However, because the data logger operates continuously and records data in a loop-like manner, data relating to the EMP prior to operation of the trigger will be recorded and available, and can be logged to long-term memory. Use of a microphone to provide a triggering signal can also provide a convenient way to test triggering, by making a suitable noise close to the microphone.

In a further alternative the triggering signal may be provided by other types of arrangement or signal, such as by a wire break arrangement or such like.

A trigger reset function is provided by the data logger to rearm the logger after a trigger to ensure that an unintended trigger before the blast will not prevent logging of data from the blast.

Data loggers which include functionality to enable suitable filtering, amplification, recording/logging, triggering and trigger resetting (as described herein) to be implemented without difficulty are commercially available, for example PC oscilloscopes sold under the trade mark PICOSCOPE.

The data logged by the high speed logger 600 is then processed to compare the logged data, representative of the actual detonations, with the intended timing schedule of the detonations.

The processing may identify misfires and may also calculate the velocity of detonation for each blast hole.

The processing may be performed by a computer, such as a laptop computer, connected on-site to the high speed data logger, which has been provided with, and stored in memory, the intended timing schedule.

The electronic components of the system (including the data logger, any external or internal filters and amplifiers, and the computer) are preferably portable devices with adequate battery capacity for on-site operation, such as eight hours. The battery capacity is determined at least in part taking into account the possibility that it may take additional time for evacuation of personnel from the blast site once the charges placed and set are ready to fire.

Figure 7:
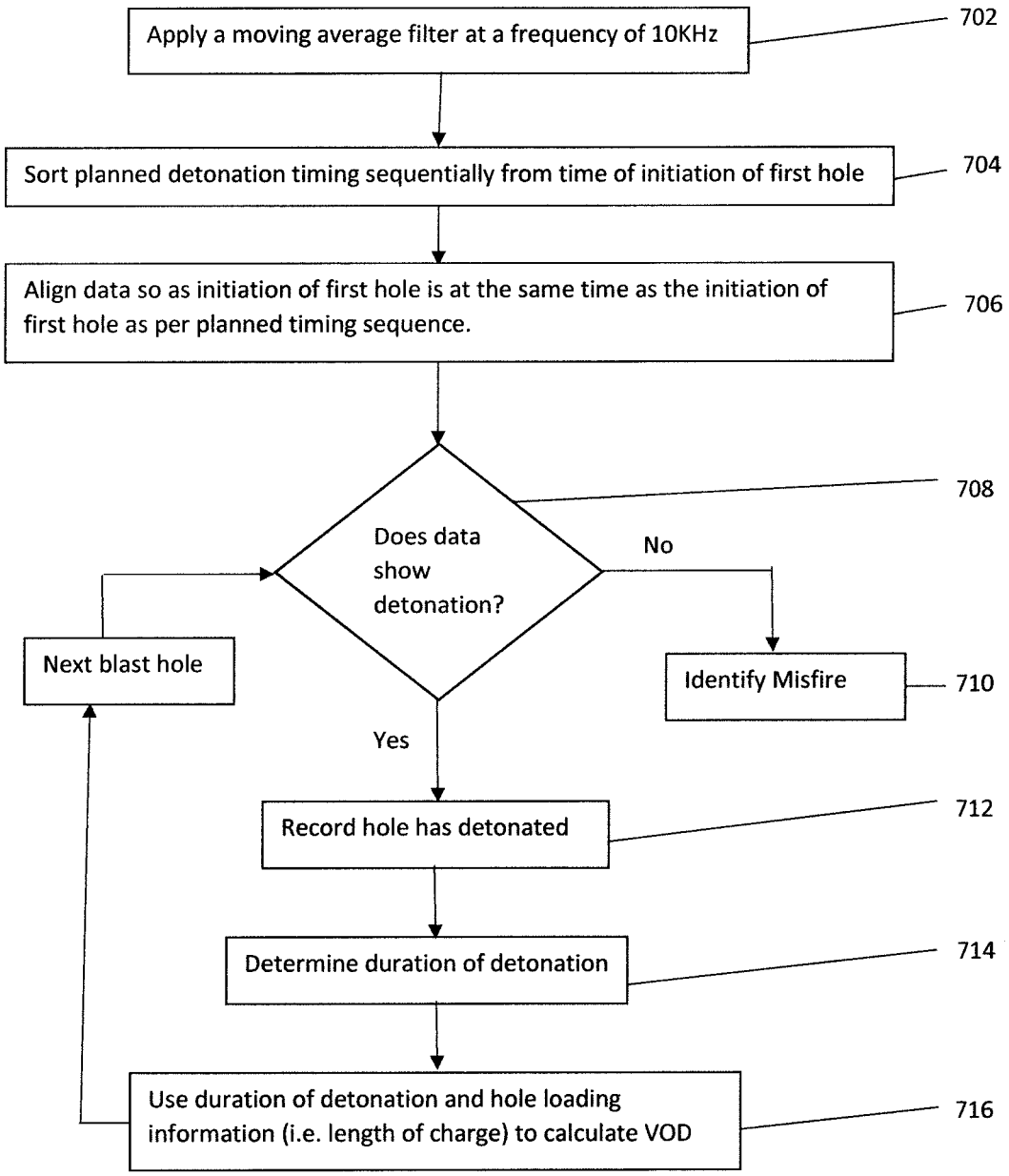
FIG. 7 is a flow diagram illustrating processing of data recorded by a data logger in an embodiment.

FIG. 7 provides a schematic flow sheet which illustrates the processing of the logged data.

The data is first filtered using a 10 KHz moving average, or low pass filter, as represented at block 702. Such filtering integrates the signal and removes the high frequency component to facilitate identification of the EMP.

The planned, prescheduled, detonation timing is entered and sorted according to the timing, as represented at block 704.

The planned, prescheduled, detonation timing and the logged data are aligned according to timing, as represented at block 706. This can be performed, for example, by correlating a first-detected EMP with a first prescheduled detonation, or in some other manner, such as correlating a sequence of detected EMP with a prescheduled sequence of detonations.

At the time of a first prescheduled detonation the logged data is analysed to determine whether a detonation has occurred, as represented at block 708.

If no detonation is identified at or close to the prescheduled detonation time for the blast hole, then that blast hole is recorded as having misfired, as represented at block 710.

If a detonation is identified at or close to the prescheduled detonation time for the blast hole, then that blast hole is recorded as detonated, as represented at block 712. The difference between the prescheduled timing of the detonation and the actual timing of the detonation (as identified from the logged data) may be calculated, and if the difference exceeds a predetermined threshold the blast hole and/or the timing difference may be identified accordingly.

When a blast hole is recorded as detonated the duration of the detonation is measured, as represented at block 714. This may be as simple as measuring the duration of the corresponding EMP from the logged data.

The hole loading information is used to determine the length of the explosive column in the blast hole. The length of the explosive column and the duration of detonation are used to calculate the velocity of detonation, as represented at block 716.

The velocity of detonation (VOD) is a commonly used metric to assess explosive performance. VOD may be calculated as the length of the explosive column divided by the duration of detonation. In practice, VOD is a function of the confinement (ground conditions), density and composition of the explosive.

The processing, as represented at blocks 708 to 716, is then repeated for each successive prescheduled detonation of each respective blast hole.

The results of the processing may be output by the computer, for example as a table of results (as will be described below, in due course).

Figure 8:
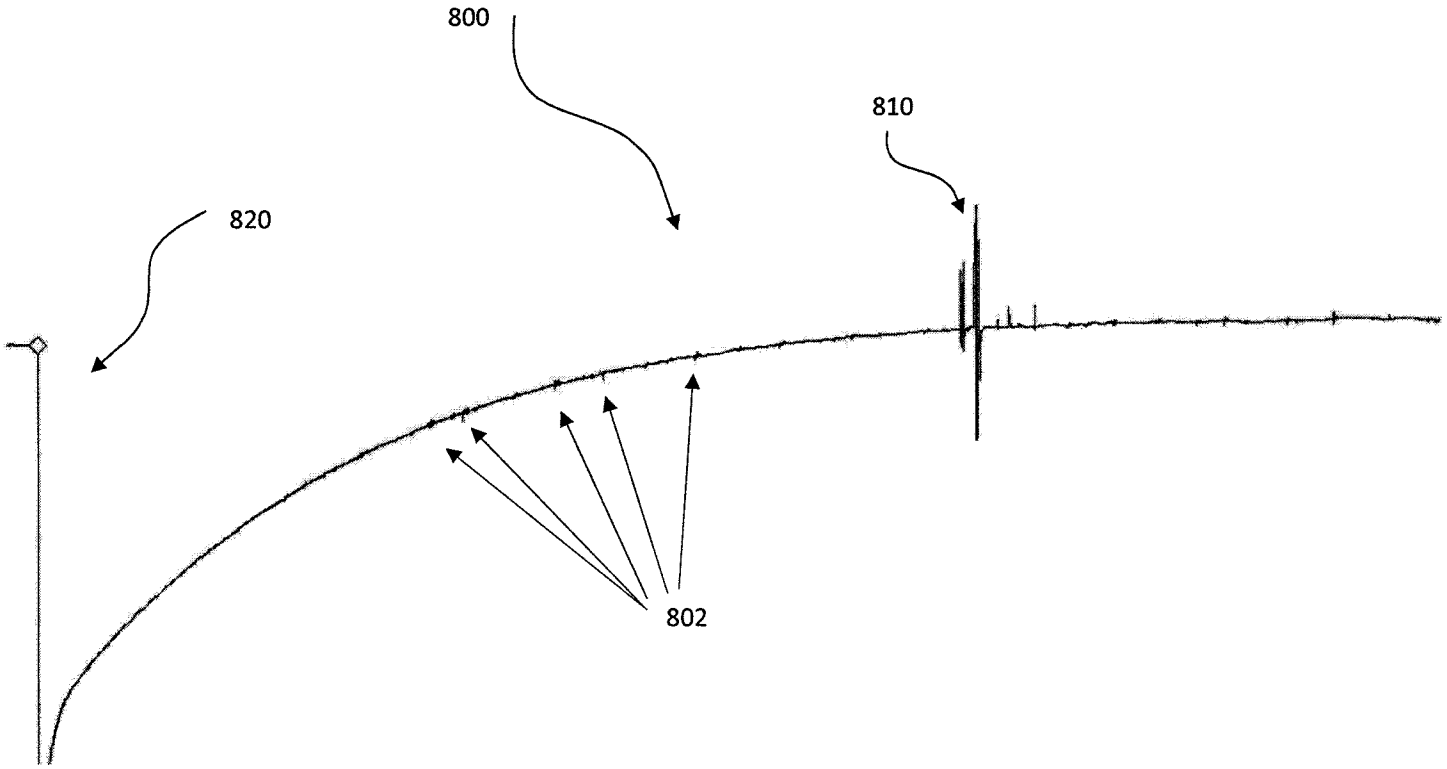
FIG. 8 is a graphical representation of a signal recorded from a blast by a system according to an embodiment in accordance with the present disclosure.

By way of example, FIG. 8 is a graphical representation of a signal 800 received by an antenna placed on the surface of the blast pattern and recorded by a high speed data logger, showing voltage (y-axis) against time (x-axis). A 10 kHz moving average filter has been applied to the data.

The signal 800 includes a number of small voltage fluctuations 802, representative of EMPs caused by detonations. The larger fluctuations 810 are a result of the antenna being in close proximity to particular blast holes. The step change 820 results from the detonation of a surface detonator which was programmed to a known detonation time to be used as the reference time for all EMP generated by detonations and to be used as a trigger. The step change is due to the antenna detecting a large EMP pulse and then becoming charged due to contact with ionised gas and dust.

Figure 9:
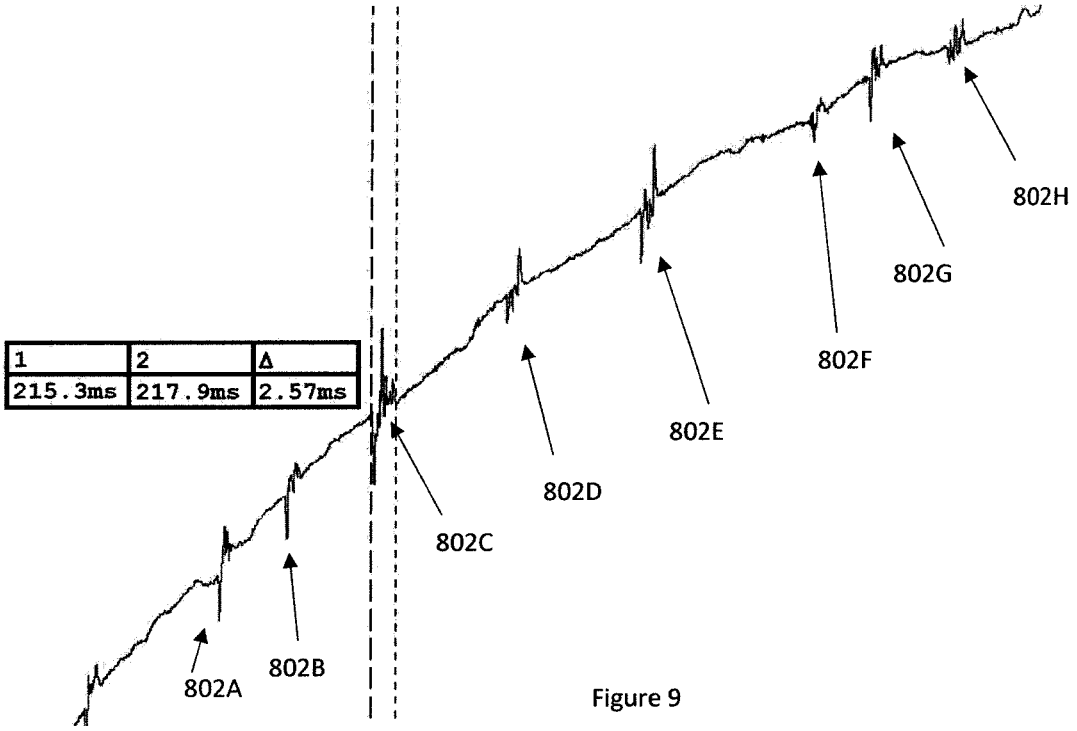
FIG. 9 is a graphical representation of part of a signal, in enlarged form, including measurement relating to the duration of a blast.

The EMP from some successive timed detonations of explosives in blast holes are more clearly discernible in the enlarged part of a signal illustrated in FIG. 9, in which some example small voltage fluctuations 802A to 802H are shown in more detail. A time measurement of the start (column 1, and represented by the log-dash vertical line), end (column 2, and represented by the short-dash vertical line) and duration (capital delta) of one of the small voltage fluctuations 802C originating from the EMP caused by a detonation in a blast hole is shown. As previously stated, the duration of the EMP corresponds substantially to the duration of the detonation. It will be appreciated that corresponding measurements can easily be made, from the logged data, for each detected EMP corresponding to a detonation in a blast hole.

Figure 10:
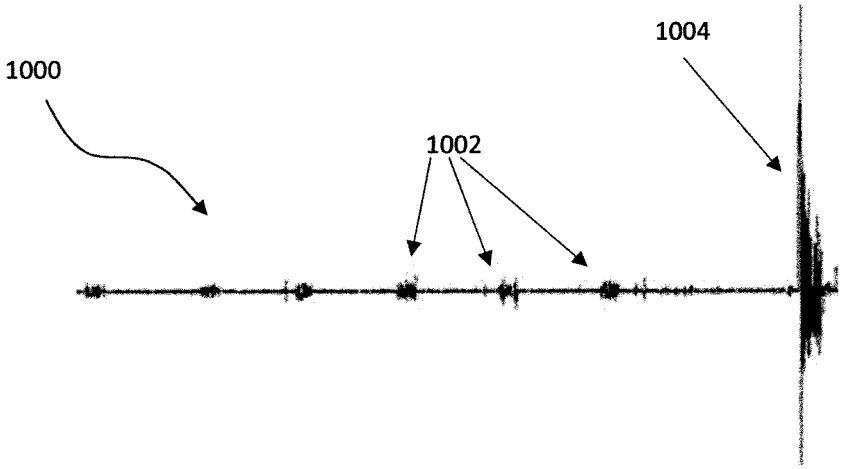
FIG. 10 is a further graphical representation of part of a signal.

FIG. 10 illustrates schematically a part of a signal 1000 received by a ground antenna arrangement and resulting from detonation of explosives in a timed sequence, and illustrates the difference in magnitude of signal regions resulting from EMP produced by various individual detonations 1002 and a signal region 1004 resulting from a detonation in close proximity to the ground antenna steel stake.

Table 1 presents, by way of illustrative example, some results of the type of processing described above, and especially in relation to FIG. 7, using logged data obtained as described herein, in relation to a signals resulting from EMP caused by a sequence of detonations of explosives in blast holes in a mine.

TABLE 1

| Hole Number | Planned delay ms | Actual Delay ms | EMP Duration ms | VOD m/s |
|---|---|---|---|---|
| 1 | 1016 | 1016 | 1.9 | 4646 |
| 2 | 1051 | 1051 | 1.6 | 5089 |
| 3 | 1053 | 1053 | 1.7 | 4848 |
| 4 | 1055 | 1055 | 1.8 | 4547 |
| 5 | 1057 | 1057 | 2.0 | 4312 |
| 6 | 1059 | 1059 | 1.7 | 4881 |
| 7 | 1064 | 1064 | 1.7 | 4941 |
| 8 | 1071 | 1071 | 1.8 | 4776 |
| 9 | 1080 | 1080 | 1.9 | 4447 |
| 10 | **1086** | **1087** | 1.5 | 5294 |
| 11 | 1093 | 1093 | 1.5 | 5176 |
| 12 | 1096 | 1096 | 1.9 | 4593 |
| 13 | 1110 | 1110 | 1.7 | 4884 |

TABLE 1-continued

| Hole Number | Planned delay ms | Actual Delay ms | EMP Duration ms | VOD m/s |
|---|---|---|---|---|
| 14 | 1122 | 1122 | 1.8 | 3821 |
| 15 | 1128 | 1128 | 2.2 | 3620 |
| 16 | 1135 | 1135 | 1.7 | 4853 |
| 17 | 1139 | 1139 | 1.9 | 4254 |
| 18 | 1143 | 1143 | 2.2 | 4107 |
| 19 | 1155 | 1155 | 2.1 | 4110 |
| 20 | 1185 | 1185 | 1.7 | 4766 |
| 21 | 1199 | 1199 | 1.7 | 4781 |
| 22 | 1206 | 1206 | 1.6 | 4881 |
| 23 | 1215 | 1215 | 2.5 | 3255 |
| 24 | 1229 | 1229 | 1.8 | 4592 |
| 25 | 1243 | 1243 | 2.0 | 4065 |
| 26 | 1267 | 1267 | 1.9 | 4250 |
| 27 | 1275 | 1275 | 1.9 | 4254 |
| 28 | 1291 | 1291 | 2.0 | 4063 |
| 29 | 1338 | 1338 | 2.4 | 3825 |
| 30 | 1382 | 1382 | 2.0 | 4263 |
| 31 | **1399** | **1398** | 1.8 | 4712 |
| 32 | 1426 | 1426 | 2.3 | 3579 |
| 33 | 1442 | 1442 | 1.6 | 5050 |
| 34 | **1445** | **1446** | 1.7 | 4821 |
| 35 | 1459 | 1459 | 1.8 | 4908 |

It should be appreciated that the measurements for 'Actual delay', that is, based on the logged data relating to the EMP, were calculated to a greater accuracy than that shown in the above table, and rounded to the nearest millisecond (ms) to correspond to the planned (prescheduled) sequence being set out in milliseconds. Thus deviations between the planned sequence timing and the measured sequence timing of less than half a millisecond do not appear as errors in Table 1. However it can be seen that the comparison of measured timing and planned timing shows deviations from the planned timing of greater than half a millisecond (and less than 1.5 milliseconds) for blast holes 10, 31 and 34. As illustrated in table 1, where deviations from the planned timing of greater than a predetermined threshold are identifiable, the corresponding results are identified by a difference in presentation of the corresponding results, compared to the presentation of results for detonations which did not deviate in timing from the planned timing. In Table 1 bold and underlined font is used, by way of example only, but any desired difference in presentation (such as colour, font size, or inclusion of a flagging icon) could be used if desired Additionally or alternatively, if desired, an additional column providing numerical values for the calculated deviation in timing for each blast hole (or only for those blast holes for which the deviation exceeds a predetermined or selected threshold) may be included.

The close correlation, shown in Table 1, between the measured timing and the planned timing of the detonations in the blast sequence is considered to support the view that the calculations are accurate.

It can also be note that Table 1 identifies no misfires.

Table 1 further shows the EMP durations, corresponding to the duration of the detonations for the corresponding blast holes.

Table 1 further shows the calculated VOD for the explosive in each blast hole.

It should be appreciated that the accuracy of the VOD calculation is dependent on the accuracy of the data provided relating to the lengths of the respective columns of explosives. Any error in the length of a column of explosive will result in a substantially proportional error in the calculated VOD. The data relating to the lengths of the respective columns of explosives may, in practice, be dependent upon the parameters or measurements for the blast hole, including blast hole depth, distance of the detonator from the bottom of the blast hole and the stemming height. It should also be appreciated that the numerical values provided in Table 1 are presented by way of illustrative example only, and have in some cases (such as the 'EMP Duration' values) been rounded to assist presentation, so that the accuracy of the values displayed does not necessarily represent the accuracy (i.e. the number of significant figures) used in the corresponding calculations discussed herein. Further it will be appreciated that, if desired, the length of the explosive column for each blast hole (used, along with the EMP duration to calculate the VOD) could be included in the output table of results, to assist in showing how each VOD value is arrived at.

The data logger has a very high sampling rate and captures a large amount of data, particularly for blasts that are several seconds in length. Subsequent data analysis can be tedious and time consuming. Consequently a number of blasts have only been partially analysed to demonstrate the concept. Table 1 contains data from a portion of a large blast. This was instrumented solely with one EMP antenna and no other downhole instrumentation.

In use, the apparatus of the invention may be used primarily to determine misfiring of explosive charges in mining and similar applications and/or to compare the actual detonation timings with the planned detonation sequence.

A further use for the described system may be realised when used in conjunction with a pressure sensor which detects pressure waves travelling through the rock mass which result from a detonation. This can allow the speed of a detected pressure wave in the rock mass (ground mass) to be measured, providing useful information regarding the characteristics of the rock mass, which can assist mining operations.

Pressure sensors for detecting such pressure waves in a rock mass are known per se. In a particular embodiment the pressure sensor comprises of a pressure sensor component embedded in epoxy, is approximately 13.5 mm in diameter and approximately 52 mm long and is attached to a coaxial cable for attachment to an input channel of the high speed data logger.

In an embodiment the pressure sensor may comprise a block of carbon in an electric circuit. On the application of pressure the volume of the block of carbon reduces, which in turn causes a reduction in electrical resistance. If follows that a drop in pressure applied the carbon causes an increase in volume and hence an increase in electrical resistance. This is the same operating principal as carbon microphones used in early telephones.

In this embodiment the output signal of the pressure sensor is signal is a possible maximum of 0.0053 amps at 2.5 VDC which is less than 0.2 amps (1 Ohm/0.2V, 55 Ohm/11V or 120 Ohm/24 V), which is considered a safe limit (the "no-fire" power limit) for electronic detonators.

The pressure sensor can detect pressure waves from a detonation. Such pressure waves travel through the rock mass at a speed dependent on the characteristics of the rock mass, but typically of the order of 1000 metres per second to 3000 metres per second. Knowledge of the distance, D, between the sensor and the detonation, and the time, t, taken for the pressure wave to travel from the detonation to the sensor, enables the speed of the pressure wave to be determined using the formula:

$$\text{Speed}=D/t.$$

Depending on the location of the pressure sensor, the pressure wave may be expected to take between about 2.5 ms (7 m at 3000 metres per second) and 50 ms (50 m at 1000 metres per second) to travel from the detonation to the pressure sensor. The pressure sensor may be provided close to the data logger if desired, however, it is considered desirable to install the pressure sensor in one of the blast holes, and to arrange for the pressure wave measurement to be taken of a pressure wave resulting from a detonation in a nearby, and in an embodiment, neighbouring, blast hole. A cable, such as a coaxial cable may be run from the pressure sensor to the high speed data logger.

The time interval between detection of the EMP and detection of the pressure wave can be easily extracted from the data logged by the high speed data logger.

The speed of the EMP from a detonation (the speed of light) is around five orders of magnitude greater than the speed of the pressure wave. Because of the high speed of the EMP, the time taken for the EMP to travel from the detonation to the antenna arrangement of the system (given a distance of the order of 50 m) will be of the order of microseconds, which is several orders of magnitude less than the time taken for the pressure wave to travel from the detonation to the pressure sensor. Accordingly, if desired for convenience, any delay between the detonation itself and detection of the EMP from the detonation can effectively be ignored when considering the time taken for the pressure wave to travel from the detonation to the pressure sensor. Similarly the time taken for an electrical signal from the pressure sensor to be transmitted to the data logger (e.g. along the coaxial cable) can also be ignored for convenience. Accordingly, the extracted time interval between detection of the EMP from a detonation and detection of the pressure wave (from the same detonation) can be treated as being the time taken for the pressure wave to travel from the detonation to the sensor.

Thus the speed of the pressure wave in the rock mass (ground mass) can be measured by dividing the distance between the detonation and the pressure sensor by the interval between detection of the EMP and detection of the pressure wave. Such measurement of the speed of the pressure wave can provide useful information regarding the characteristics of the rock mass, which can assist mining operations.

In order to know the distance of the pressure sensor from the detonation for a detected pressure wave, it is of course important to be able to know, or be able to determine which detonation (that is, which blast hole) the detected pressure wave originates from. One way of ensuring that the pressure wave can be correlated to a detonation in a particular blast hole is to provide the pressure sensor in a blast hole adjacent the blast hole that is scheduled to be detonated first. Under at least most circumstances this ensures that the first pressure wave detected by the pressure sensor is the pressure wave from the first detonation.

Figure 11:
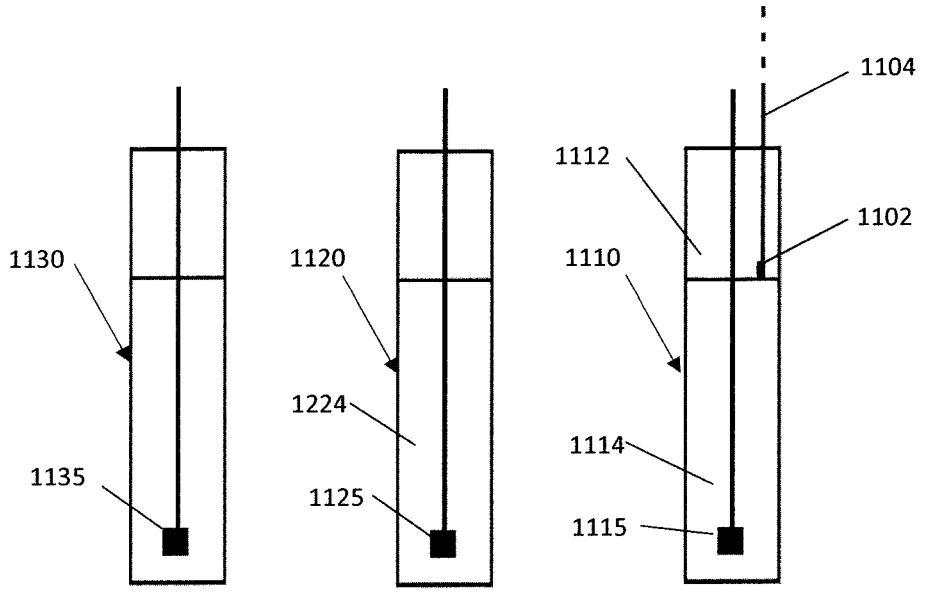
FIG. 11 is a schematic illustration showing deployment of a pressure sensor.

FIG. 11 illustrates, schematically and by way of example, a pressure sensor 1102 located in a first blast hole 1110. The pressure sensor 1101 is provided in a stemming region 1112 of the blast hole, adjacent an explosive charge region 1114, and has an associated cable 1104 which extends out of the first blast hole 1110 to relay a signal from the pressure sensor 1102 to a high speed logger (not shown) which is provided with an antenna arrangement, for example as described above, for detecting EMP from detonations in blast holes of a mine, (including, in this embodiment, the first blast hole 1110). As described above, the data logger can be provided in a location such that it is protected from blasting.

The first blast hole 1110 has been selected for location of the pressure sensor 1102, because it is adjacent a second blast hole 1120, and it is desired to measure the pressure wave resulting from detonation of explosives 1124 in the second blast hole 1120. In this embodiment the second blast hole is the initial blast hole of a detonation sequence for a plurality of blast holes. The plurality of blast holes scheduled for detonation may include the first blast hole 1110, and one or more further blast holes 1130. Each blast hole 1110, 1120, 1130 has an associated booster 1115, 1125, 1135.

Figure 12:
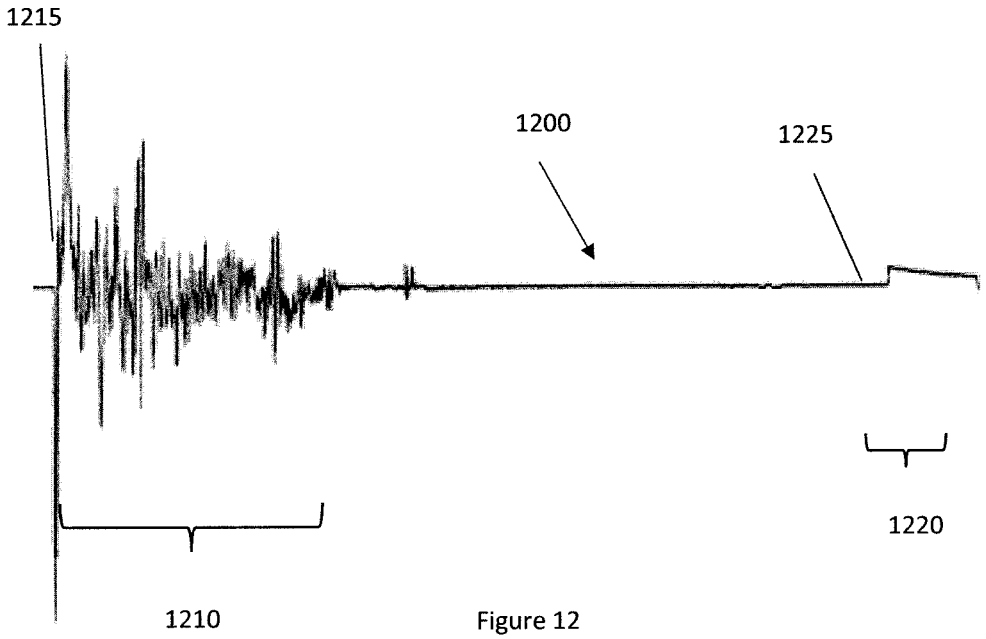
FIG. 12 is a schematic representation of part of a signal including a signal part resulting from a pressure wave.

FIG. 12 is a graphical representation of part of a signal 1200 recorded by a high speed data logger, showing voltage (y-axis) against time (x-axis). The signal 1200 includes an EMP region 1210 resulting from detonation of explosive in a blast hole (for example the second blast hole 1120 described above) detected by an antenna arrangement, for example as described above. The signal 1200 further includes a pressure wave region 1220, for example resulting from use of a pressure sensor (for example pressure sensor 1102) provided in a blast hole adjacent the detonated blast hole. The EMP region 1210 has a beginning or start point 1215. The pressure wave region has a beginning or start point 1225. In the illustrated signal part the pressure wave (or shock wave) has a magnitude of about 0.005 GPa. The time interval between the start points 1215, 1225 can readily be measured along the x axis. As described above, this time interval may be regarded as representing the time taken for the pressure wave to travel from the detonated blast hole to the sensor. Thus the speed (or velocity of propagation) of the pressure wave, in the ground mass material between the detonation and the sensor, may be calculated by dividing the distance between the detonation and the sensor by the measured time interval.

The described embodiments of systems and methods for wireless measurement of detonation of explosives provide working advantages over certain previously used approaches.

The antenna used in measurement of the detonations is non-invasive in the blast holes, and the embodiments described require no connection to any instrumentation in the blast holes. Consequently destruction of equipment used to measure the detonations is avoided or mitigated.

In relation to the measurement of misfires and deviations from planned timing sequences the described embodiments provide facilitated measurement compared to at least some previous approaches.

In relation to the measurement of VOD, at least some previously used techniques use cables to transmit the data from the blast hole to a recording device. Such techniques can only be used when the hole is detonated from the toe. An advantage of described embodiments is that it does not matter if the booster is located in the toe or the collar of the blast hole. The measurement is the duration of the EMP generated by the detonating explosive, and the only additional information required to calculate the VOD is the charge length.

Of course, the above features or functionalities described in relation to the embodiments are provided by way of example only. Modifications and improvements may be incorporated without departing from the scope of the invention.

The claims defining the invention are as follows:

1. A system for wireless measurement of detonation of explosives for detonation according to a timed sequence, the system comprising:

an antenna for detecting electromagnetic emissions resulting from detonation of the explosives and providing an electromagnetic signal representative of the electromagnetic emissions;

a high speed data logger operatively connected to the antenna for logging the electromagnetic signal, wherein the high speed logger records at a sampling frequency of at least 1 MHz;

a trigger for setting the data logger for logging the electromagnetic signal upon detonation of the explosives to produce a recorded blast record; and a comparison arrangement for comparing the timed sequence with the recorded blast record, wherein the comparison arrangement is adapted to apply a low pass filter to the recorded blast record to facilitate comparing the timed sequence with the recorded blast record.

2. The system according to claim 1, wherein the system is for wireless measurement of detonation of a plurality of chemical explosive charges located in respective spaced blast holes in a mine.

3. The system according to claim 1, wherein the antenna comprises a wire cable system connected to and used to configure electronic detonators which initiate the detonation of the explosives.

4. The system according to claim 1, wherein the antenna comprises at least one metal electrode connected to a ground mass by insertion into a hole provided in the ground mass.

5. The system according to claim 1, wherein the antenna comprises an elongate conductor provided above or along a floor or ground surface.

6. The system according to claim 1, wherein the system comprises a signal amplifier for amplifying the signal provided by the antenna.

7. The system according to claim 1, wherein the comparison arrangement comprises a computer which receives data comprising the recorded blast record from the data logger.

8. The system according to claim 1, wherein the comparison arrangement comprises a detonation matching functionality for matching the individual detonations represented by the recorded blast record to corresponding scheduled detonations of the timed sequence.

9. The system according to claim 1, wherein the comparison arrangement is operable to identify, for each scheduled detonation, whether the signal representative of the electromagnetic emissions indicates that a corresponding detonation has been detected, and for each scheduled detonation in relation to which a corresponding detonation has not been detected, that a misfire has occurred.

10. The system according to claim 1, wherein the comparison arrangement is operable to calculate a timing difference between each scheduled detonation and the timing of a corresponding detonation included in the recorded blast record.

11. The system according to claim 1, comprising a computer operable to calculate the duration of each detonation included in the recorded blast record and to calculate the velocity of detonation for each explosive based on the charge length of each explosive, and the duration of the detonation of that explosive.

12. A method for wireless measurement of detonation of explosives for detonation according to a timed sequence, the method comprising:

providing an antenna for detecting electromagnetic emissions resulting from detonation of the explosives so that the antenna provides an electromagnetic signal representative of the electromagnetic emissions;

providing a high speed data logger operatively connected to the antenna for logging the electromagnetic signal, wherein the high speed logger records at a sampling frequency of at least 1 MHz;

using a trigger to set the data logger for logging the electromagnetic signal upon detonation of the explosives to produce a recorded blast record; and comparing the timed sequence with the recorded blast record, wherein a low pass filter is applied to the recorded blast record to facilitate comparing the timed sequence with the recorded blast record.

13. The method as claimed in claim 12, wherein the antenna is provided between 10 and 90 metres of at least one of the explosives to be detonated.

14. A system for wireless measurement of detonation of a plurality of chemical explosive charges according to a timed sequence, the system comprising:

an antenna for detecting respective, substantially discrete electromagnetic pulses resulting from detonation of the plurality of chemical explosive charges and providing an electromagnetic signal representative of the electromagnetic pulses;

a high speed data logger operatively connected to the antenna for logging the electromagnetic signal, wherein the high speed data logger records at a sampling frequency of at least 1 MHz;

a trigger for setting the data logger for logging the electromagnetic signal upon detonation of the explosives to produce a recorded blast record; and a comparison arrangement for comparing the timed sequence with the recorded blast record, wherein the comparison arrangement applies a low pass filter to the recorded blast record to facilitate comparing the timed sequence with the recorded blast record, wherein the antenna of the system comprises:

at least one metal electrode inserted in a rock mass and configured to detect the electromagnetic pulses travelling through the rock mass;

a wire cable system connected to and used to configure electronic detonators which initiate detonation of the explosive charges; or an elongate conductor adjacent and/or across blast sites corresponding to the plurality of chemical explosive charges.

* * * * *